US006994662B2

(12) United States Patent
Jörnborn et al.

(10) Patent No.: US 6,994,662 B2
(45) Date of Patent: Feb. 7, 2006

(54) MACHINE FOR PUNCHING BLANKS OUT OF A WEB OF CORRUGATED CARDBOARD AND FOR FORMING FOLDING LINES IN SAID BLANKS

(76) Inventors: Stefan Jörnborn, Poseidonvägen 30, S-554 38, Jönköping (SE); Tommy Rydberg, Ängstigen 4, S-566 32 Habo (SE)

( * ) Notice: Subject to any disclaimer, the term of this patent is extended or adjusted under 35 U.S.C. 154(b) by 0 days.

(21) Appl. No.: 10/504,221

(22) PCT Filed: Feb. 12, 2003

(86) PCT No.: PCT/IB03/00486

§ 371 (c)(1),
(2), (4) Date: Aug. 11, 2004

(87) PCT Pub. No.: WO03/068491

PCT Pub. Date: Aug. 21, 2003

(65) Prior Publication Data

US 2005/0079969 A1 Apr. 14, 2005

(30) Foreign Application Priority Data

Feb. 13, 2002 (DK) ..... 2002 00215

(51) Int. Cl.
*B31B 1/16* (2006.01)

(52) U.S. Cl. ..... 493/56; 493/60; 493/62; 493/64; 493/402; 493/475; 493/478

(58) Field of Classification Search ..... 493/56, 493/60, 62, 64, 396, 401, 402, 475, 478; 83/331, 343, 344, 481, 346–348, 659, 660, 83/698.41, 698.51, 699.61; 72/184, 185, 72/191, 252.5

See application file for complete search history.

(56) References Cited

U.S. PATENT DOCUMENTS 3,752,042 A * 8/1973 Castille ..... 493/471
4,020,724 A * 5/1977 Quinlan ..... 83/346
4,732,083 A * 3/1988 Arter et al. ..... 101/28
4,878,407 A * 11/1989 Harrison et al. ..... 83/13
5,001,950 A * 3/1991 Fokos et al. ..... 83/37
5,095,830 A * 3/1992 Love ..... 101/28
5,194,064 A * 3/1993 Simpson et al. ..... 493/402

(Continued)

*Primary Examiner*—Louis K. Huynh
*Assistant Examiner*—Hemant M Desai
(74) *Attorney, Agent, or Firm*—Donald S. Dowden; Cooper & Dunham LLP

(57) ABSTRACT

A machine for punching blanks (10) of corrugated cardboard out of a web or plates of corrugated cardboard and for forming folding lines (5) in said blanks. The machine has two cylinders (2, 3) rotating towards each other and of which at least one cylinder is provided on the outer surface with a curved wooden plate (6). The punching tools and the folding line tools (8, 9) are mounted on said wooden plate by being pressed into slits in said wooden plate (6). The cylinders (2, 3) are made of metal, preferably steel. The wooden plate (6) is secured to the cylinder (2, 3) by being screwed (15) thereon. The wooden plate is centered on the cylinder by means of two adjustable rings (4) on the cylinder. Each ring (4) is provided with an axially directed guide projection (4*a*, 4*b*) adapted to interact with an end notch (6*a*, 6*b*) in the wooden plate. In this way, it is rendered possible in a very simple way to centre the wooden plate and consequently the punching tool in relation to the vertical centre plane of the cylinder.

9 Claims, 2 Drawing Sheets

U.S. PATENT DOCUMENTS 5,429,577 A * 7/1995 Simpson et al. ..... 493/354
5,582,571 A * 12/1996 Simpson et al. ..... 493/355
5,935,367 A * 8/1999 Hollenbeck ..... 156/252
6,032,565 A * 3/2000 Okonski et al. ..... 83/522.15

* cited by examiner

MACHINE FOR PUNCHING BLANKS OUT OF A WEB OF CORRUGATED CARDBOARD AND FOR FORMING FOLDING LINES IN SAID BLANKS

This application is U.S. National stage filed under 35 U.S.C. 371 based on International Application PCT/IB03/00486 filed on Feb. 2, 2003; which claims priority from Denmark application No. PA 2002 00215 filed Feb. 13, 2002.

TECHNICAL FIELD

The present invention relates to a machine for punching blanks out of a web of corrugated cardboard and for forming folding lines in said blanks, said machine including two cylinders rotating towards each other and of which at least one cylinder is provided on the outer surface with a curved wooden plate, preferably made of plywood, punching tools and folding line tools being mounted on said wooden plate by being pressed into slits in said wooden plate.

In the present application, the expression "wooden plate" is to be interpreted in very broad terms as the plate can also be made of plastics, optionally reinforced plastics.

BACKGROUND ART

U.S. Pat. Nos. 5,641,551 and 6,162,155 disclose a rotation punching machine is known which has two cylinders rolling towards each other, said machine being intended for punching corrugated cardboard blanks out of a web of corrugated cardboard. On one cylinder, a wooden plate is mounted by means of screws which serve to support the punching tool necessary for the punching operation. However, the machine does not operate entirely satisfactorily because it is not possible to centre, viz. adjust, the wooden plate and thus to centre the punching tool on the cylinder so as to position the punching tool correctly in relation to the corrugated cardboard web passing between the cylinders. These documents fail to disclose use of adjustment rings on one of the cylinders. U.S. Pat. No. 6,162,155 discloses particularly the feature that one cylinder is metallic.

DISCLOSURE OF INVENTION

The object of the present invention is to provide a machine of the type mentioned above which in a very simple way allows a centering of the wooden plate and consequently the punching tool in relation to the cylinder.

The machine according to the present invention is characterised in that the cylinders are made of metal, preferably steel, and that the wooden plate is secured to the cylinder, for instance by being screwed thereon, and that the wooden plate is centred on the cylinder by means of two adjustable rings on the cylinder whereby at least one ring is automatically rotatable or axially displaceable, each ring being provided with an axially directed guide projection adapted to interact with an end notch in the wooden plate. In this way, a centering of the wooden plate is obtained in a very simple manner as the rings are slightly rotated or axially displaced a short distance so that the punching tool of the wooden plate is pushed exactly to the desired position in relation to the cylinder and in relation to the corrugated cardboard web passing through the machine. During the centring procedure the wooden plate is slightly loosened in relation to the cylinder, for instance by some screws being loosened and fastened again.

According to the invention, a least one of the rings may be connected to means for an automatic, for instance hydraulic, axial displacement or turning on the cylinder, whereby a particularly easy and reliable adjustment of the wooden plate and consequently of the position of the punching tool on the cylinder is ensured.

In addition, according to the invention, the curved wooden plate may be mounted in a recess in the surface of the cylinder with the result that an increased stabilisation of the wooden plate in relation to the cylinder is obtained.

According to the invention, one cylinder is advantageously provided with a male punching tool in form of knives.

According to the invention, the other cylinder is advantageously provided with a female punching tool mounted on a curved wooden plate on said cylinder. It is further advantageous when the male punching tool and the female punching tool can interact.

Finally, according to the invention, the rings may advantageously be formed by end rings on the cylinder.

BRIEF DESCRIPTION OF THE DRAWINGS

The invention is explained in detail below with reference to the drawings, in which.

BEST MODES FOR CARRYING OUT THE INVENTION

Figure 1:
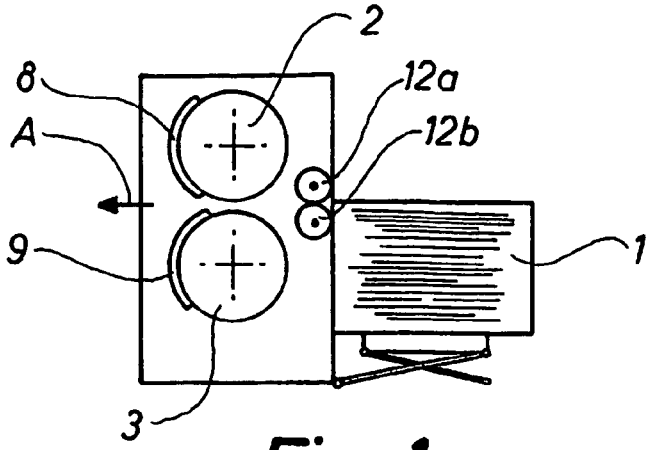
FIG. 1 is a diagrammatic side view of an embodiment of the machine according to the invention.

The machine shown in FIG. 1 is suited for punching blanks of corrugated cardboard out of a web of corrugated cardboard or plates thereof positioned in a corrugated cardboard supply 1. While the blanks are being punched out they are also being provided with folding lines. These lines can for instance be positioned as indicated by the dotted lines 5 in FIG. 5.

Figure 2:
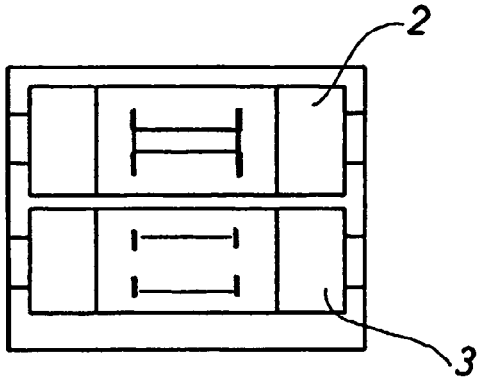
FIG. 2 is a diagrammatic front view of the same.
Figure 4:
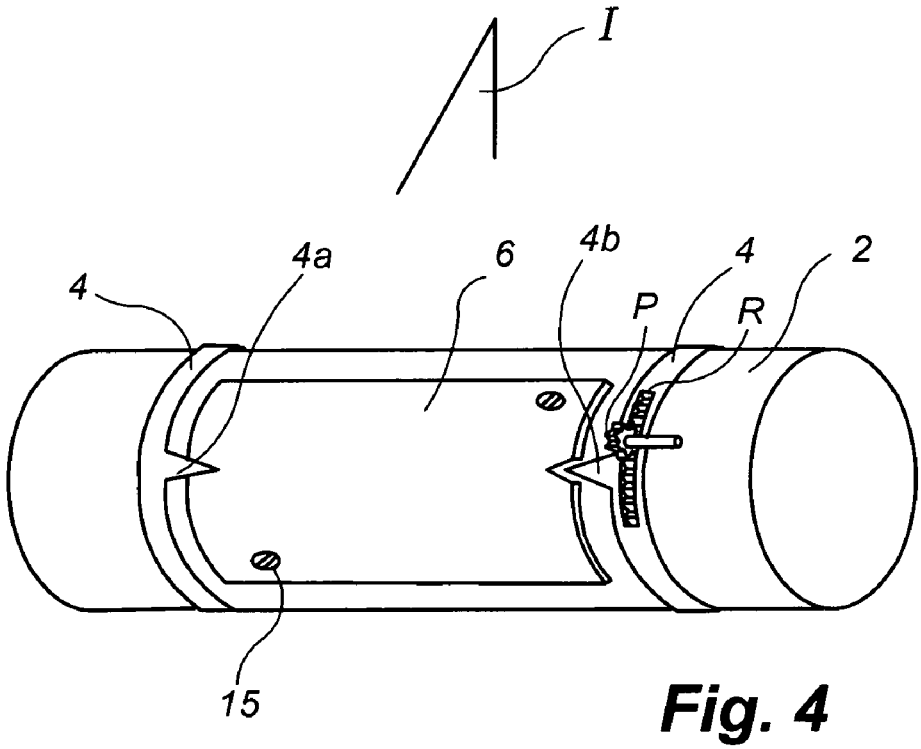
FIG. 4 is a perspective view on a larger scale of a rotation cylinder.

As shown in FIG. 2, the machine includes two cylinders 2, 3 rotating towards each other and of which at least one 2 or 3 is provided on the outer surface with a curved wooden plate 6, cf. FIG. 4. The above punching tool and folding line tool are mounted on said wooden plate by being pressed into slits in the concave surface of said wooden plate. As the punching tool and the folding line tool have different appearances depending on the different punching purposes, a particular wooden plate would have to be produced for every purpose, said particular wooden plate being provided with slits in the correct locations, viz. where the punching line means and the folding line means are to be inserted, in order to produce a ready-made punching blank having the correct shape and having folding lines in the correct locations.

Figure 6:
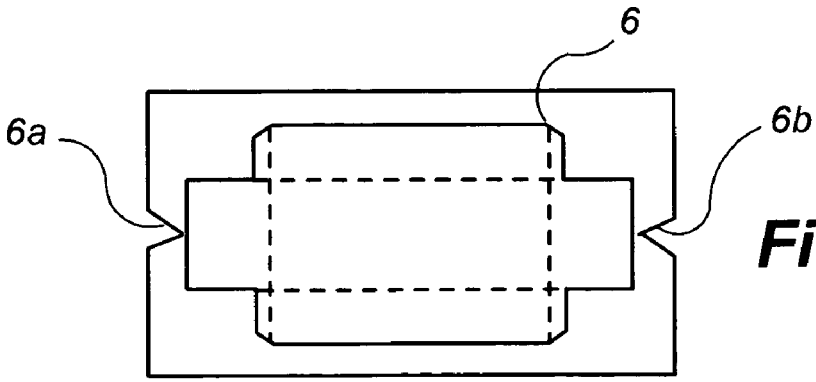
FIG. 6 is a front view of a curved wooden plate.

The cylinders 2, 3 are made of metal, preferably steel, and the wooden plate 6 is secured to the relevant cylinder, for instance by being screwed thereon by means of screws 15 or a screw joint. The centring of the wooden plate 6 in relation to the vertical centre plane I of the relevant cylinder can present a problem. However, this problem is solved by providing at least one, preferably two, adjustable thin rings 4 having an axially directed guide projection 4*a*, 4*b* which are adapted to interact with end notches 6*a*, 6*b* in the wooden plate, cf. FIG. 6. The position of the rings 4 is adjustable in the longitudinal direction of the cylinder, for instance by means of screws.

The rings 4 can optionally be connected to means for an automatic turning or axial displacement or both actions of the rings on the cylinder, for instance by means of a hydraulic circuit having a sliding piston and/or rack R and pinion gear P mechanism. However, the rings are preferably only to be moved within relatively short distances. Optionally, the rings 4 can be end rings, i.e. positioned on their respective end of the cylinder 2.

The wooden plate 6 is curved and can be embedded in a recess in the surface of the cylinder 2 or 3, said recess, however, not being shown. The bottom of the recess is also cylindrical as it has a cylinder surface mating to the concave surface of the wooden plate. The recess is usually longer than the length of the wooden plate so that the latter can be axially displaced in the recess.

Optionally, both cylinders 2 and 3 can be provided with wooden plates 6. This is particularly relevant when the wooden plate on the cylinder 2 is provided with a male tool 8 in form of knives. The wooden plate of the cylinder 3 can be provided with a female punching tool 9, cf FIG. 1.

Figure 3:
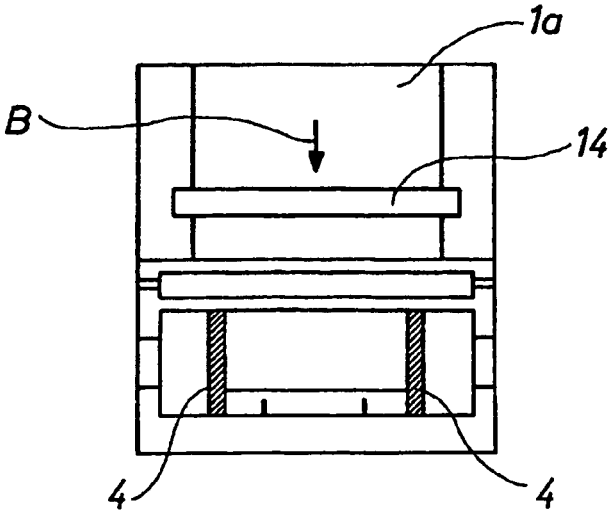
FIG. 3 is a diagrammatic top view of the same.
Figure 5:
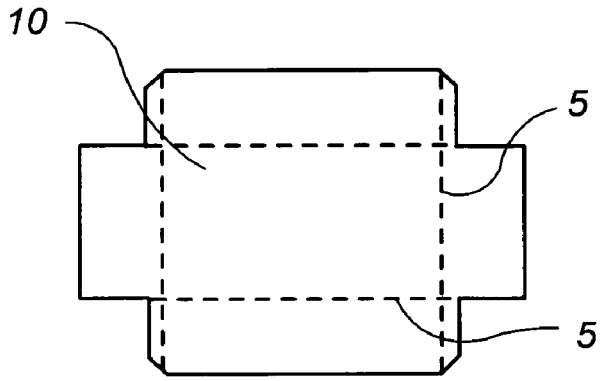
FIG. 5 shows a blank punched out on the machine according to the invention.

FIGS. 1 and 3 show how the always top corrugated cardboard plate la can be pulled in the direction of the arrow B into the clamping area of a set of advancing rollers 12*a*, 12*b*. The advancing of the corrugated cardboard plate to the advancing rollers is carried out by means of a vacuum feeding device 14 which can suck in the corrugated cardboard plate and move it forwards horizontally. When the corrugated cardboard plate has reached the advancing rollers 12*a*, 12*b*, said advancing rollers push the corrugated cardboard plate into the opening between the cylinders 2 and 3, whereafter the punching tools and the folding line tools of said cylinders punch out a blank and at the same time provide folding lines on said blank. The processed blank, viz. FIG. 5, and the residual material pass forward in the direction of the arrow A, cf. FIG. 1. The blank is collected in a manner known per se.

The invention has been described in connection with punching blanks out of corrugated cardboard plates, but the invention can equally well be carried out in connection with a continuous web of corrugated cardboard, said web being pulled off of a roll of corrugated cardboard.

Concerning the rings 4, it is noted that the thickness thereof measured in radial direction is less than the thickness of the curved wooden plate 6.

The invention can be varied in many ways without deviating from the scope of the present invention.

What is claimed is:

1. A machine for punching blanks (10) of corrugated cardboard out of a web or plates of corrugated cardboard and for forming folding lines (5) in said blanks, said machine including two cylinders (2, 3) rotating towards each other and of which at least one cylinder is provided on the outer surface with a curved wooden plate (6), punching tools and folding line tools (8, 9) being mounted on said wooden plate by being pressed into slits in said wooden plate (6), wherein the cylinders (2,3) are made of metal and said wooden plate (6) is secured to said one cylinder (2, 3) and centred on said one cylinder by means of two adjustable rings (4) on said one cylinder whereby at least one ring (4) is automatically rotatable or axially displaceable, each ring (4) being provided with an axially directed guide projection (4*a*, 4*b*) adapted to interact with an end notch (6*a*, 6*b*) in the wooden plate.

2. A machine according to claim 1, wherein at least one of the rings (4) is connected to means for an automatic turning or axial displacement or both actions on said one cylinder (2, 3).

3. A machine according to claim 2 further comprising a hydraulic mechanism for effecting said turning or displacement.

4. A machine according to claim 1 wherein the curved wooden plate (6) is mounted in a recess in the surface of said one cylinder (6).

5. A machine according to claim 1 wherein the wooden plate (6) of said one cylinder (2) is provided with a male punching tool (8) in form of knives.

6. A machine according to claim 5 wherein the other cylinder (3) is provided with a female punching tool (9) mounted on a curved wooden plate on said other cylinder (3).

7. A machine according to claim 1 wherein the wooden plate is made of plywood.

8. A machine according to claim 1 wherein the cylinders are made of steel.

9. A machine according to claim 1 further comprising screws for screwing the plate to said one cylinder.

* * * * *